United States Patent [19]

Antenen

[11] Patent Number: 4,965,969

[45] Date of Patent: Oct. 30, 1990

[54] GUTTER GUARD

[76] Inventor: Dan E. Antenen, 1391 New London Rd., Hamilton, Ohio 45013

[21] Appl. No.: 323,363

[22] Filed: Mar. 13, 1989

[51] Int. Cl.[5] ..... E04D 13/00

[52] U.S. Cl. ..... 52/12; 248/48.1

[58] Field of Search ..... 52/11, 12, 13, 14, 15, 52/16; 248/48.1, 48.2

[56] References Cited

U.S. PATENT DOCUMENTS

| | | | |
|---|---|---|---|
| 453,948 | 6/1891 | Smith et al. . | |
| 870,165 | 11/1907 | Hagler et al. | 52/12 X |
| 2,175,138 | 10/1938 | Westlake . | |
| 2,288,121 | 6/1942 | Cisar et al. | 248/48.2 |
| 2,734,467 | 2/1956 | Steele . | |
| 2,879,961 | 3/1959 | Bertram | 248/48.1 |
| 2,899,158 | 8/1959 | Reheis | 248/48.2 |
| 2,935,954 | 5/1960 | Matthews et al. . | |
| 3,053,393 | 9/1962 | McLean . | |
| 3,436,878 | 4/1969 | Singer | 52/12 |
| 4,395,852 | 8/1983 | Tang | 52/12 |
| 4,418,504 | 12/1983 | Lassiter . | |
| 4,455,791 | 6/1984 | Elko et al. | 52/12 |
| 4,467,570 | 8/1984 | Kriegel . | |
| 4,497,146 | 2/1985 | Demartini | 52/12 |
| 4,592,174 | 6/1986 | Hileman | 52/12 |
| 4,796,390 | 1/1989 | Demartini | 52/12 |

*Primary Examiner*—David A. Scherbel
*Assistant Examiner*—Creighton Smith
*Attorney, Agent, or Firm*—Wood, Herron & Evans

[57] ABSTRACT

A gutter guard formed of a flexible strip of lattice-like plastic or expanded metal material has an upper edge insertable beneath the lower ends of the lowermost course of shingles overlying the gutter of a sloped roof, and has a lower edge which extends over and around the upper outer gutter edge. Tabs cut into material above the lower edge of the strip can be easily depressed downwardly by hand during installation to engage from below the underside of the inwardly facing lip at the outer gutter edge. Alternating flaps formed between the tabs, or a continuous outer edge extending along the tabs, project beyond the tabs and fold in line with the lower tab ends to hook over and around the gutter lip. The hooked outer edge is either flat initially and plastically deformable at installation over the gutter edge, or it is preformed into a hook extending below the tab ends. The material is sufficiently flexible so as to package in a roll.

22 Claims, 3 Drawing Sheets

GUTTER GUARD

The present invention relates to gutter guards and more particularly to guards for covering gutters installed at the eaves of buildings to prevent leaves and other foreign objects from entering the gutters and downspouts while permitting water from the roof of the structure to drain therethrough.

Gutters which line the eaves of structures to direct the flow of water from roofs and into downspouts have been susceptible to clogging from the accumulation of leaves and other natural debris. Various forms of gutter covers or guards have been used in the prior art to prevent such debris from entering the gutters. The purpose of these guards is to permit the passage of water into the gutters while straining from the water leaves, sticks, and other objects which would otherwise clog the gutters and downspouts, blocking the passage of water therethrough. It is common for such gutter guards to be manufactured of either rigid or flexible material forming a matrix defining a plurality of holes therethrough so that the solid material is strained from the water and supported by the guard while the water is allowed to pass through the holes in the guard and into the gutter. Such matrices have been formed of cut sheet metal, screen, woven wire, expanded metal, molded plastic and other materials. Examples of such gutter guards which have been manufactured of screen or woven wire are shown in U.S. Pat. Nos. 453,948 and 2,734,467. A guard of expanded metal is shown in U.S. Pat. Nos. 2,175,138. Several gutter guards formed of cut sheet metal are shown in U.S. Pat. Nos. 2,935,954, 3,053,393, 4,418,504, and 4,467,570. Each of these prior art guards has one or more disadvantages overcome by the present invention.

Several of the prior art proposals have attempted to provide a gutter guard which is either sufficiently strong and durable, easy to secure, easy to manufacture or low in cost. Each has made compromises, providing only some of these features.

In the prior art, guards of expanded metal, woven wire or thermoplastic mesh have been the most economical and have found widespread use. Such guards are typically formed of a strip of lattice-like material and supplied in a roll for easy packaging and from which they can be unrolled and laid over the gutter. The simplest are kept in place by being tucked beneath the lowest course of shingles to support the upper edge of the strip between the shingle course and the roof. The lower edge of such guards is usually made to rest upon the outer edge of the gutter or is tucked loosely below the gutter outer lip to rest upon a ledge formed in the outer gutter wall below the gutter lip. In some cases, the gutter spikes which hold the gutter to the eave are relied upon to at least partially support the guard.

A problem found with such lattice type gutter guards is that they are inadequately fastened to the gutter and thus are frequently dislodged by wind or heavy rain. More seriously, however, is the problem of the guard slipping laterally away from the gutter outer wall. This occurs under the weight of debris or ice. Guards which escape support under the weight of ice and debris permit the leaves and other foreign material to drop into the gutter and are difficult to reposition.

In attempts to solve the fastening problem, some gutter screens of the prior art have resorted to separately formed clips or hooks, some permanently connected to, and others separate from, the strip in order to hold the gutter guard to the outer rim of the gutter. Such techniques for using separately fabricated fastening devices increase the cost and destroy the simplicity of the drain screen or lattice type gutter guard. Separate clips which have been proposed have not been simple to install. Others have been made part of the guard and have required an assembly procedure in the manufacture of the guard.

Gutter guards of rigid sheet metal have been manufactured with integrally formed clips and hooks which allow the gutter guard to be fastened to the gutter or roof. These more costly sheet metal gutter guards are better suited for new construction than for installation in existing structures where their lack of flexibility renders them difficult to retrofit to the structure. In addition, these rigid sheet metal guards have been heavier, are difficult to handle and cost more to manufacture. Because of these disadvantages, rigid guards, though often more durable and less likely to dislodge or fail, have been less readily accepted by users.

With either the rigid or the flexible type of gutter guard it is of particular importance to have fastening means which hold the lower edge of the gutter guard to the outer rim of the gutter preventing the guard from being uplifted from the gutter or poked down into the gutter by wind, rain or the weight of the filtered debris. It is important that the guard fasten to the gutter or roof in such a way as to keep the gutter guard from sliding away from the roof or away from the gutter outer edge. Accordingly, the fastening means considered in the prior art have employed a variety of configurations, some exceedingly complex, to stabilize and hold the gutter guard in place above the gutter and against the roof edge.

Accordingly, there has been and remains a need for a gutter guard, particularly a gutter guard of the economical lattice type, which is easy to install and which will securely fasten to and be held in place against the gutter. There is a more particular need to provide such a guard of the type which is flexible and can be rolled as a strip into position.

It is a primary objective of the present invention to overcome the problems of the prior art and to provide an effective, efficient and economical gutter guard which will fasten securely in place at the gutter. It is a particular objective of the present invention to provide a gutter guard which can be fabricated without the need for assembly of separate parts, and which can be installed easily by hand without the need of tools or special skills. It is a more particular objective of the present invention to provide a gutter guard which preferably utilizes the flexibility and compactness of a rollable screen strip and which has fastening means integrally formed of the strip, thus avoiding the need to employ more exotic and expensive manufacturing or assembly methods to provide the fastening means to hold the guard to the gutter.

According to the principles of the present invention, there is provided a gutter guard formed of a strip of lattice-like material which can be tucked beneath the existing shingles of a roof and which has integrally formed therein means for securing the lower edge of the strip to the outer lip of the gutter rim. According to the preferred embodiment of the present invention, there is provided a gutter guard made of screen-like lattice material, preferably of expanded metal or molded synthetic material such as thermoplastic or other molded plastic mesh, which has an upper edge insertable under the existing shingles of a roof and a lower edge either deformable or predeformed so as to overlie and hook around the outer lip of the gutter. The gutter guard according to the preferred embodiment of the present invention also is provided with manually deformable tabs having lower tips which are spaced inward of the outer edge of the guard and which are resiliently or plastically deformable downwardly by hand so as to be easily snapped downwardly to hook under the inwardly projecting flange of the outer lip of the gutter. Gutters of most conventional designs are formed with an outer edge having an inwardly extending upper lip. The guard so provided functions to clip and hold the gutter lip between the tabs and the guard outer edge.

In the preferred embodiment of the invention, the outer edge of the guard extends beyond the tips of the tabs and folds down over the outer edge of the gutter. The fold which the outer edge makes is approximately in line with the tips of the tabs. Thus, the flaps hold the gutter guard outer edge to the edge of the gutter and support the guard against downward deflection from the weight of debris. These flaps help keep the guard from pulling away from the edge of the gutter. The tabs on the other hand cooperate with the flaps to prevent the lifting of the guard from the gutter edge and to prevent the sliding of the guard from under the shingles.

In accordance with certain preferred embodiments of the present invention, the outer edge and tabs form a scalloped shape. This outer edge extends beyond the tabs in the form of flaps spaced alternately with the tabs along the length of the lower edge of the gutter guard. According to other embodiments of the present invention, the lower edge is continuous and the tabs are formed by U-shaped cuts to define the tabs along and above the lower edge of the guard, with the tips of the tabs spaced approximately in line with the folds of the guard which extends over and around the outer edge of the gutter about the gutter rim. With either arrangement, the gutter guard is prevented from lifting or sagging at the outer edge away from or into the gutter and is prevented from sliding in its plane toward or away from the roof. In addition, such a guard will fit a range of gutter sizes.

Optional clips are provided to add additional security to the fastening in certain embodiments. In addition, in other embodiments, particularly those wherein the material is plastic, supporting ribs are pre-formed transverse to the strip to stiffen the plastic material. Preferably, the ribs are molded into the plane of the lattice. A matrix material having a grid pattern formed on a bias or on intersecting diagonals is preferred in the embodiments illustrated.

The gutter guard designed in accordance with the principles of the present invention can be manufactured from a single continuous strip of lattice-like material such as wire, mesh or expanded metal. With such strips, it is unnecessary to form and attach separate components in the manufacture of the guard according to the present invention. This provides an important cost advantage in the manufacture of the guard, as the strip material may merely be cut by a continuous process to form the tabs along the length of the strip material. The guard which results is thus easy to install on a gutter by hand without tools or special skills. In installation, the outer edge of the strip can be bent or folded by hand over the gutter while the tabs can be pushed by hand down below the gutter lip where they spring upwardly against the lip to hold the guard flaps or outer edge down against the lip by reaction to the upward force exerted by the tabs from below. As a result, an easy to manufacture and economical gutter guard is provided which is easy to use and to install and which is superior to more complex and expensive devices of the prior art.

These and other objectives and advantages of the present invention will be more readily apparent from the following detailed description of the drawings in which.

Figure 1:
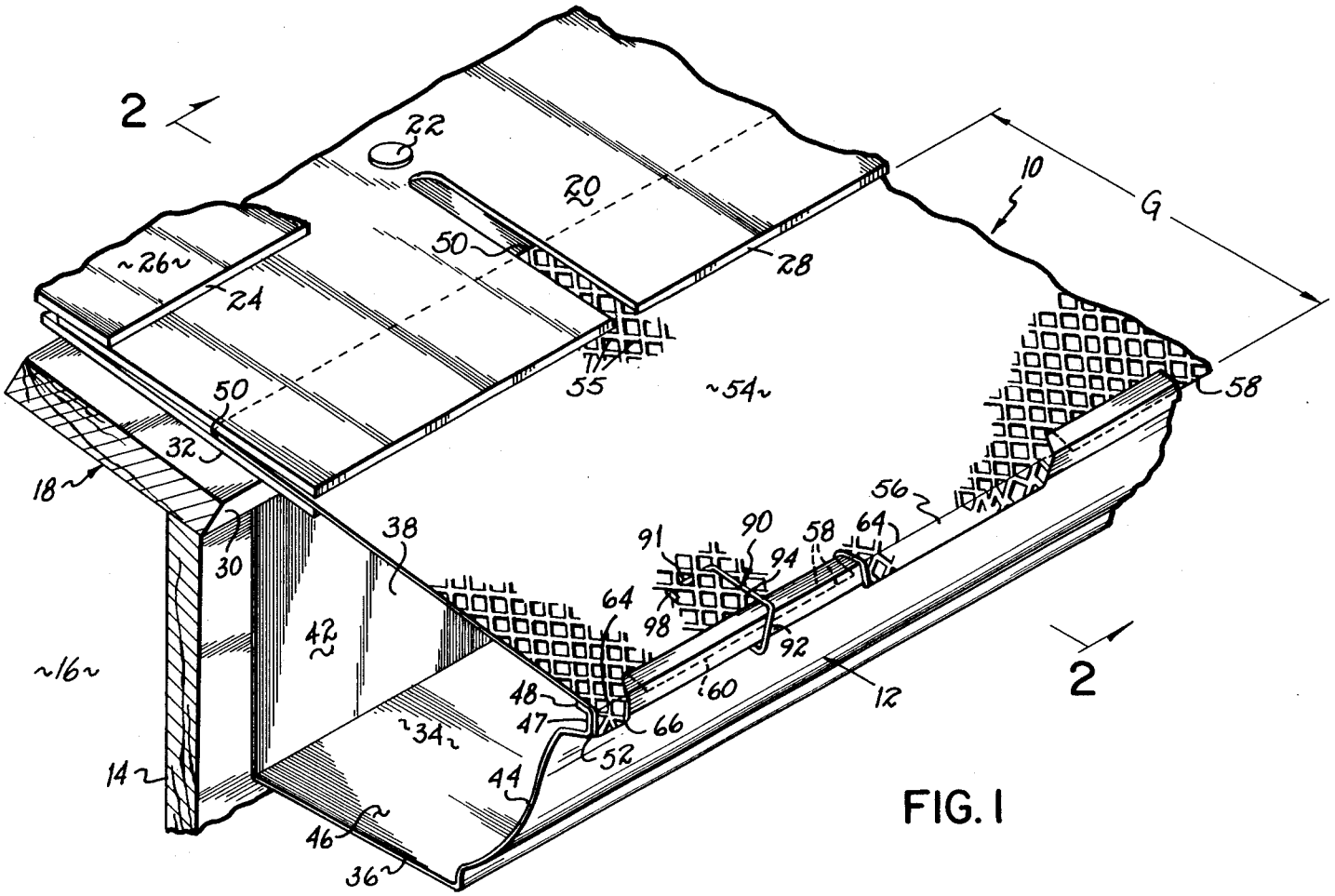
FIG. 1 is an isometric perspective view of a portion of the gutter, eave and roof area of a building structure showing assembled onto the gutter a gutter guard according to one preferred embodiment of the present

Referring to FIG. 1, a gutter guard 10 according to the principles of the present invention is shown. The guard 10 is illustrated installed on a gutter 12. The gutter 12 is part of an existing building structure 16, and is supported upon the eave face 14 of the structure 16 at the lower edge of a roof 18 of the structure 16. The roof 18 of the structure 16 is illustrated as a conventional asphalt shingled roof, the lower course 20 of shingles being secured by nails 22 to the roof 18, the nails 22 being concealed by a lower edge 24 of the second shingle course 26. The shingle course 20 has its lower edge 28 extending beyond the lower edge 30 of the structure of roof 18 yet slightly overlying the gutter 12 so that the rain or other water draining from the roof drains into the gutter 12. The lower edge 28 of the shingle course 20 loosely lies upon the roof 18. The shingles of the course 20 are usually sufficiently flexible so as to be elastically liftable from the roof 18 by hand. The lower course of shingles 20, in conventional construction, frequently overlies a starter course of shingles 32 which are secured at their lower edge by nails 33 to the roof structure 18. This can better be seen by reference to FIG. 2.

Figure 2:
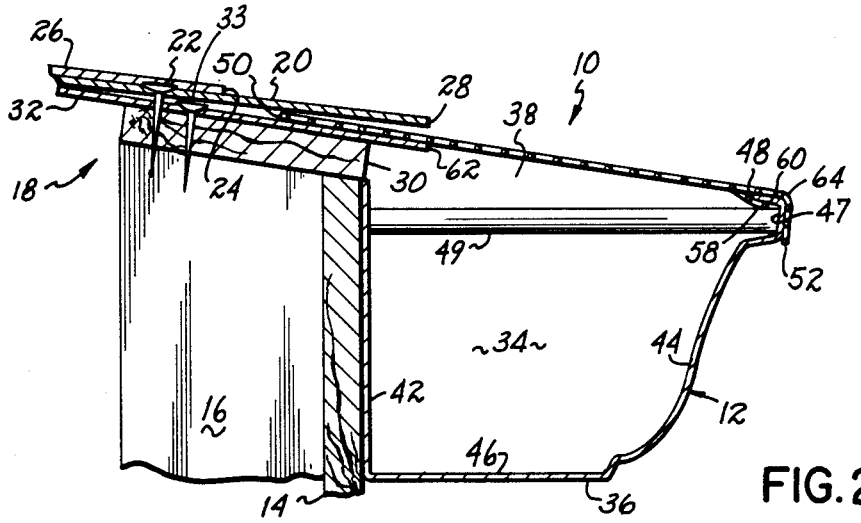
FIG. 2 is a cross-sectional view along line 2—2 of FIG. 1.

Referring to FIGS. 1 and 2, the gutter 12 shown is of one conventional style being of a single piece of sheet material 36, usually of sheet metal, having an upwardly facing U-shape defining an interior cavity or water trough 34 therein, with an open upper side 38 into which water flowing from the shingle course 20 will flow. The gutter 12 has formed of the sheet 36 an upstanding inner wall portion 42 mountable to, and shown secured flushly against, the eave 14, an upstanding outer side portion 44 and a horizontal bottom portion 46 joining and formed integrally with sheet material 36 of which the gutter 12 is formed. The upper edge 47 of the outer gutter wall 44 is formed into an inwardly facing hooked lip 48. The gutter 12 is supported to the eave 14 usually by spaced gutter hanger nail and spacer sets 49 which extend through the outer edge 47 and the inner wall 42 and into the eave 14 and into the frame of the building structure 16.

Figure 3A:
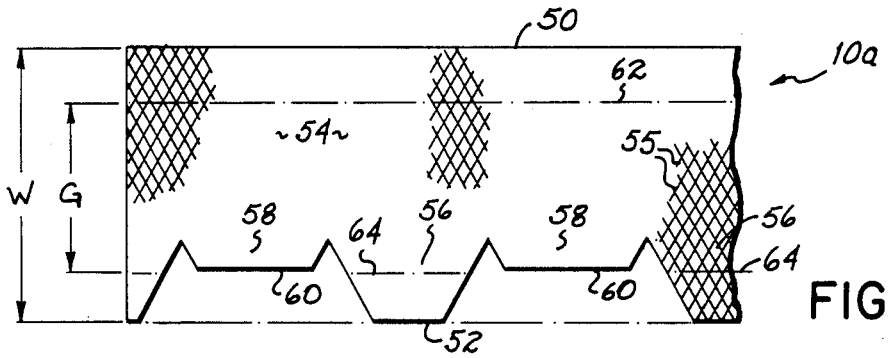
FIG. 3A is a plan view of an uninstalled section of gutter guard strip, preferably of a plastically deformable soft metal, formed in accordance with one preferred embodiment of the present invention.

Referring to FIG. 3A, a first preferred embodiment **10*a* of the gutter guard 10 of the present invention is illustrated having an upper edge 50 and a lower edge 52 parallel to the upper edge 50. The parallel edges 50 and 52 bound the gutter guard 10 and defines its total width W. The gutter guard 10*a* of this embodiment is formed of a single piece material 54 preferably of expanded sheet metal lattice defining a matrix or mesh in a diagonal or bias orientation pattern 55. The expanded metal mesh material 54 is a flexible strip usually supplied in roll form which is soft enough, flexible enough and light enough to be both elastically and plastically deformable by hand. The lower edge 52 of the guard 10*a* defines the outer or lower edges of a plurality of longitudinally spaced flaps 56, trapezoidal in shape, which are cut in the guard 10*a* from the strip of mesh material 54. Alternately cut into the material 54 in the spaces between the flaps 56 is a plurality of tabs 58, each also trapezoidal in shape but shorter than the flaps 56, and each having an outer edge 60 which is spaced a lesser distance from the inner edge 50 than is the outer edge 52**.

Installation of the guard 10 on the gutter 12 is similar for various of the embodiments of the invention, and is described for embodiment **10*a* by reference to FIGS. 1, 2 and 3A. The gutter guard 10 is installed by inserting the upper edge 50 under the lower course 20 of the shingles and overlying the roof 18 above the starting course 32 of the shingles. This is accomplished by manually lifting the lowermost edge 28 of the shingle course 20 and inserting the edge 50 thereunder to some depth which allows the opposite lower edge 52 of guard 10 to overlie lip 48 of gutter edge 47. Typically, this depth will be from 1½" to 3" so that the lower edge 28 of the shingle lower course 20 coincides with the line 62 in the drawings. The guard 10 is so inserted until the edges 60 of the tabs 58 only slightly overlie the inwardly facing lip 48 of the outer edge 47 of the gutter 12. At this point, as shown in FIGS. 1 and 2, the tabs 58 are manually depressed and downwardly urged from the position shown in the blank in FIG. 3A to the position shown in FIGS. 1 and 2. As this is accomplished the tabs 58 snap beneath the lip 48 of the edge 47 of the gutter 12. As a result, the lower edge 60 of each of the tabs 58 is spaced from line 62 and the lower edge 28 of the shingle course 20 a distance approximately equal to or slightly less than the overall width G of the gutter 12**.

So installed, the flaps 56 are then overlying the lip 48 and extending beyond the outer edge 47 of the gutter 12. Initially, the flaps 56 are in the flat position of the blank **10*a* shown in FIG. 3A. They are thereupon downwardly deformed manually during installation to hook around the outer edge 47 of the gutter 12, an operation which will pull the edge 50 slightly from its inserted position under the shingle course 20 such that the tabs 58 move outwardly so that the ends 60 of the tabs 58 rest against the inside of the upper hooked outer edge 47 of the gutter 12 and spring up under the lip 48 of the gutter 12. The lip 48 is then securely trapped between the tabs 58 and the flaps 56. In such a configuration, the flaps 56 will fold along lines 64 which generally align with the edge 60 of the tabs 58 as shown in FIG. 3A. The flaps 56 may further fold along additional crease lines 66 to conform to the shape of the outer edge 47 of the gutter 12**.

Additional embodiments **10*b*–10*d* of the gutter guard 10 are described in FIGS. 3B–3D, each of which will be installed on the gutter 12 as is the embodiment 10*a* as described in connection with FIGS. 1 and 2** and 3A above.

Figure 3B:
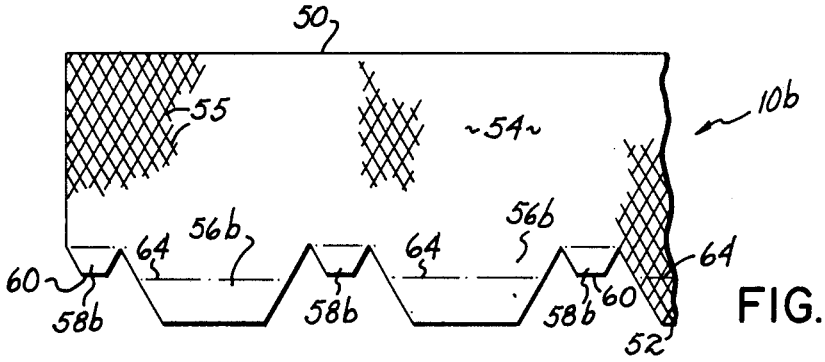
FIG. 3B is a drawing similar to 3A illustrating a second preferred embodiment of the present invention.

The second preferred embodiment of the present invention as illustrated in FIG. 3B provides a gutter guard **10*b* wherein the relative length along gutter 12 of the flap portions 56*b* with respect to the tabs 58*b* is generally larger than that of the embodiment 10*a* of FIG. 3A. This second embodiment is found to have the additional advantage of affording greater strength against the weight of debris, better preventing sag of the guard 10 while fastening more securely to the outer edge 47 of the gutter 12. This is due to the larger flaps 56 which provide a greater amount of material, and a greater proportion of the guard length, to be supported by lip 48 and to deform down and over the outer edge 47 at the outer wall 44 of the gutter 12**.

Figure 3C:
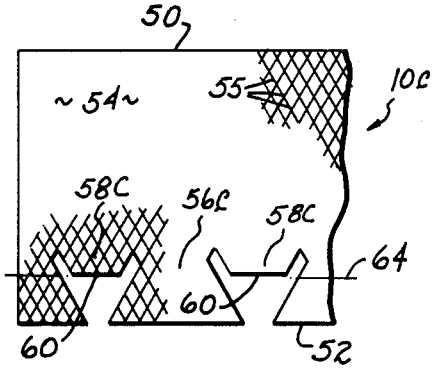
FIG. 3C is a drawing similar to 3A illustrating a third preferred embodiment of the present invention.
Figure 3D:
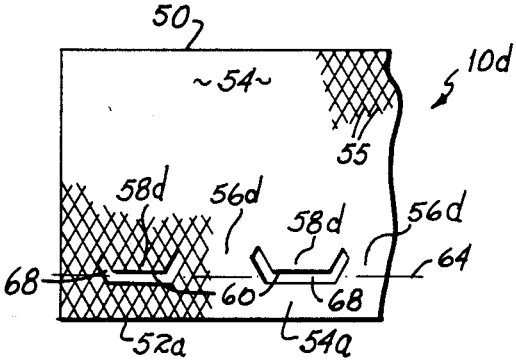
FIG. 3D is a drawing similar to 3A illustrating a fourth preferred embodiment of the present invention.

Similarly, the third preferred embodiment of a gutter guard **10*c* of FIG. 3C is a further variation of the gutter guard 10 having properties similar to the embodiment of FIG. 3B and providing additional material at the outer edges 52 of the flaps 56*c* for holding the flaps 56*c* to the outer edge 47 of the gutter 12**.

Referring further to the embodiment of FIG. D, a fourth preferred embodiment of a gutter guard **10*d* according to the present invention is shown wherein the outer edge 52 of the guard 10 is shown as being a continuous edge 52*a* with the mesh material 54 uninterrupted between adjacent flap regions 56*d*, particularly in the area 54*a* immediately to the outside of the edge 60 of the tabs 58*d*. In this embodiment, the tabs 58*d* are cut as in the embodiments described above but defined by U-shaped slots 68 punched through the material 54 in the region of the material portions 54*a* which join the adjacent flaps 56*d*** to form the continuous edge.

Figure 4B:
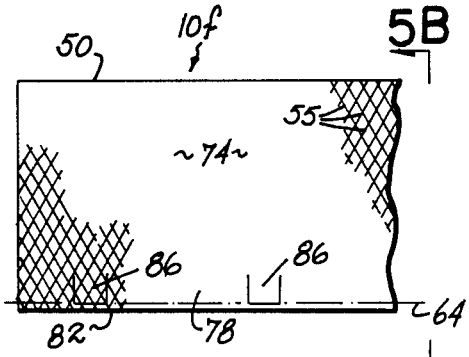
FIG. 4B is a drawing similar to FIG. 3A illustrating a sixth preferred embodiment of the present invention.
Figure 4A:
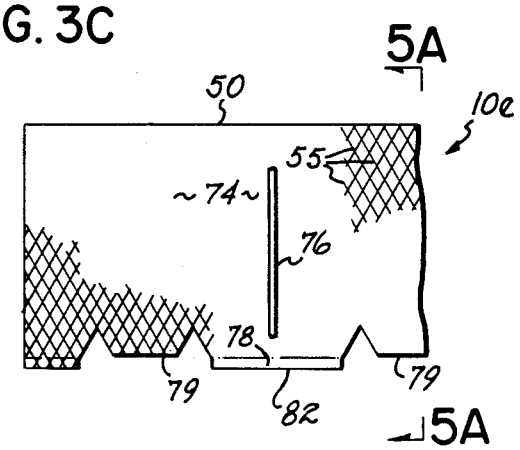
FIG. 4A is a drawing similar to FIG. 3A illustrating a fifth preferred embodiment of the present invention wherein the guard is formed of an elastically deformable material, preferably molded plastic.

While the sheet material 54 in the embodiments as shown above in FIGS. 3A–3D is preferably of the expanded sheet metal type, in the embodiments **10*e* and 10*f*, respectively, of FIGS. 4A and 4B, the sheet material is molded plastic material 74 having a diagonal matrix or bias mesh of formed molded thermoplastic material. Such material 74 may be identical in form to the material 54. The plastic material 74 has the added advantage of being generally more chemically durable and less likely to corrode. Unlike the expanded metal, the plastic material 74 possesses less natural strength and accordingly should be thicker. In that the material 74 is molded, a strengthening of the material across the width of the guard 10*e* can be achieved by forming ribs transversely as shown at 76** in FIG. 4A.

The embodiment **10*f* of FIG. 4B is similar to the embodiment of FIG. 4A. The guard 10*e* of the embodiment of FIG. 4A has a form of the scalloped edge employed in the metal embodiments of FIGS. 3A and 3B while the guard 10*f* of the embodiment of FIG. 4B is of the continuous edge 52 type such as that employed in the edge 52*a*** of embodiment of FIG. 3D.

With the plastic embodiments of FIGS. 4A and 4B, it is found that the material is more elastically deformable but less plastically deformable. That is, when it is bent, it is more likely to return to its original shape or position. At normal temperatures, the material may be difficult to plastically deform. Accordingly, in accordance with other embodiments of FIGS. 4A and 4B, a flap portion 78 is preformed at the time of manufacture, to a shape which in use will overlie and surround the upper edge 47 of the gutter 12 (FIG. 2). This may be accomplished by heating it and shaping it during manufacture, during or after the molding of the matrix, with the cutting of scalloped tabs 79 of FIG. 4A or internal tabs 86 of FIG. 4B, or at such other point in the sheet forming process which is most suitable. When so formed, the shape resembles those shapes illustrated in FIGS. 5A and 5B.

Figure 5B:
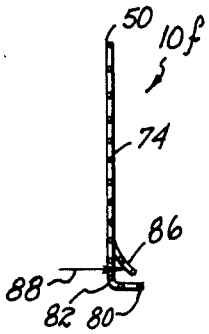
FIG. 5B is a cross-sectional view along line 5B—5B of FIG. 4B.
Figure 5A:
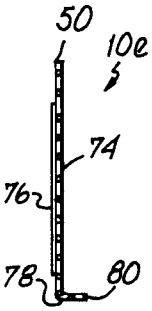
FIG. 5A is a cross-sectional view along lines 5A—5A of FIG. 4A.

Referring to FIG. 5A, the flap 78 is similar to the flap 56 of FIG. 1. The edge 80 corresponds to the edge 52 of FIG. 3A. The permanently formed crease 82 may roughly correspond to the fold 64 of FIG. 3A. It has been found that an edge preformed in the plastic material 74, as illustrated in FIGS. 5A and 5B, does not interfere with the ability of the strip to be rolled for packaging provided that the folds are made approximately one lattice dimension from the outer edge 52 of the strip 54.

With the gutter guard 10*f* of the embodiment shown in FIG. 4B, it will be seen that tabs 86 are generally resiliently retained in the plane of the gutter guard 10*f* but are manually deformable by application of force shown by arrow 88 thereto. In installation, one would deform the tabs 86 downwardly to snap them below the lip 48 of the outer edge 47 of the gutter 12 whereupon the tabs 86 will be elastically biased upwardly against the underside of the lip 48. The downward reaction to this upward force exerted by the tabs 86 will draw the flap portion 78 downwardly against the upper surface of the lip 48. The tabs 79 of the gutter guard 10*e* of FIG. 4A and 5A will function similarly to the tabs 86 of FIGS. 4B and 5B.

Figure 6A:
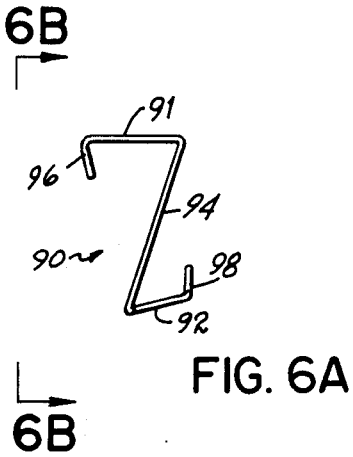
FIG. 6A is a side view of an optional spring clip as shown in FIG. 1.
Figure 6B:
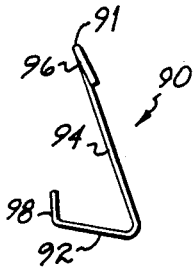
FIG. 6B is a view along line 6B—6B of FIG. 6A.

Referring again to FIGS. 1 and 2, it is an optional feature with this embodiment of the invention to secure the guard 10 to the outer edge 47 of the gutter 12 by employing the optional clips 90. The clips 90 are advantageous when used in an embodiment of the invention employing the more resilient plastic sheet material 74 of embodiments 10*e* (FIG. 4A) and 10*f* (FIG. 4B). These clips 90 are generally of the form of a twisted Z-shape as is more particularly shown by reference to FIGS. 6A and 6B. Referring to FIGS. 6A and 6B, the clip 90 is a single piece of spring wire having a first end member 91, a second end member 92, and a connecting cross member 94. At the remote ends of the end members 91 and 92 are a pair of hooked tips 96 and 98, respectively, which point toward the opposite ends generally in a direction parallel to the cross-member 94. The end members 91 and 92 are generally perpendicular to both the cross-member 94 and each other. The clip is formed preferably as two identical halves, symmetrical about the center of the cross-member 94 but twisted by 90° and such that the hooked tips 96 and 98 lie generally opposite the mid-lengths of opposing end members 92 and 91. The Z-clip 90 thus configured is reversible and can be installed without regard to the end attached to the guard 10. The first end will hook through the mesh 55 of the material 54 or 74 of the guard 10 such that an end member, say the end member 91, is generally parallel to the plane of the material 54 or 74 and to lower edge 52, with the opposite end member, say end member 92, beneath the edge 47 of the gutter 12 and preferably adjacent the tab portions 58 as shown in FIG. 1. The end 98 of the lower element 92 is sufficiently long so that its tip, which is preferably sharp, will bite into the metal of the gutter wall 44, holding it in place.

Having described the invention, the following is claimed:

1. A gutter guard for covering a gutter, wherein the gutter underlies the lower ends of the lowermost course of shingles of a sloped roof and has an inwardly projecting lower lip, said guard comprising:

a flexible, deformable strip formed of a single piece of lattice-like material and having an upper edge and a lower edge;

the upper edge of said strip being adapted for insertion beneath the lower ends of the lowermost course of shingles;

the lower edge of said strip being spaced from said upper edge a distance greater than the width of the gutter such that the lower edge of the strip, when the upper edge thereof is inserted beneath the lowermost course of the shingles, at least partially overlies the inwardly projecting lip of the gutter when said strip is installed thereon;

a plurality of tabs formed integrally in said lattice-like material and spaced from each other along the length of said strip, each of said tabs having a free lower end spaced from said upper and lower edges of said strip and positioned on said strip to overlie the lip of the gutter when said upper edge of said strip is so inserted beneath the lowermost course of shingles; and the tabs being manually deformable from a position overlying the lip of the gutter to a position below the underside of the lip of the gutter when said strip is so installed such that said lower edge of said strip and said tabs cooperate to engage the gutter lip respectfully from above and below to secure the lower edge of said strip to said gutter and to prevent the upper edge of said strip from sliding outwardly from beneath the lowermost course of shingles.

2. The gutter guard of claim 1 wherein said outer edge of said strip extends beyond said lip and is plastically deformable over and downwardly about the upper and outer surface of the lip of the gutter.

3. The gutter guard of claim 2 wherein the outer edge of said strip is plastically deformable by hand over and about the upper and outer surface of the lip of the gutter.

4. The gutter guard of claim 1 wherein said strip is sufficiently flexible as to be formed into a roll when packaged.

5. The gutter guard of claim 1 wherein said outer edge of said strip is continuous in the vicinity of the plurality of the tabs and extends outwardly beyond the lip of the gutter when so installed so that said outer edge of said strip may be formed to hook down over the lip.

6. The gutter guard of claim 1 wherein said outer edge of said strip includes a plurality of flaps extending outwardly beyond the lower edges of the tabs.

7. The gutter guard of claim 1 wherein said outer edge of said strip is continuous in the vicinity of the plurality of the tabs.

8. The gutter guard of claim 1 wherein the lattice-like material is a diagonal grid.

9. The gutter guard of claim 1 wherein the strip material is formed of expanded sheet metal.

10. The gutter guard of claim 9 wherein the expanded metal is plastically deformable by hand.

11. The gutter guard of claim 1 wherein the strip material is formed of molded plastic material.

12. The gutter guard of claim 11 wherein the strip material includes a plurality of molded ribs formed transversely of the material and spaced along its length.

13. The gutter guard of claim 11 wherein the outer edge of the strip is preformed to hook downwardly.

14. The gutter guard of claim 13 wherein said outer edge of said strip is continuous along a plurality of said tabs.

15. The gutter guard of claim 1 wherein said strip of sheet-like material is dimensioned so as to fold downwardly along folds which are approximately in line with the ends of the tabs such that said outer edge of said strip extends over and around the lip of the gutter.

16. The gutter guard of claim 1 wherein the material is at least partially resilient in the area of the tabs such that the tabs, when deformed to fit beneath the lip of the gutter, will be elastically biased upwardly against the lip so as to draw the outer edge of said strip down against the top of the gutter to trap the lip between said tabs and the outer edge of the strip.

17. The gutter guard of claim 1 wherein said outer edge of said strip includes a plurality of flaps extending outwardly beyond the lower edges of the tabs and extending beyond the lip of the gutter when so installed so that said flaps may be formed to hook down over the lip.

18. The gutter guard of claim 1 further comprising a plurality of Z-shaped hooks attachable to the strip and engageable with the upper edge of the outer side of the gutter.

19. The gutter guard of claim 18 wherein each of said hooks is formed of a single piece of spring wire twisted to a Z-shape having a cross member, and a pair of end members at each end of said cross-member, each end member forming approximately a right angle with the cross-member and with the other end member, each of said end members having a free end thereof hooked toward the other end member.

20. A gutter guard for covering a gutter underlying the lower ends of the lowermost course of shingles of a sloped roof, the gutter having an outer lip said guard comprising:

a flexible deformable strip of lattice-like material having an upper edge and a lower edge;

the upper edge of said strip being adapted for insertion beneath the lower ends of the lowermost course of shingles;

the lower edge of said strip being spaced from said upper edge a distance greater than the width of the gutter;

said lattice-like material having a free lower edge spaced from said upper edge of said strip and positioned on said strip to overlie the lip of the gutter when said upper edge of said strip is so inserted beneath the lowermost course of shingles; and a plurality of Z-shaped hooks attachable to the strip and engageable with the upper edge of the outer side of the gutter; and wherein each of said hooks is formed of a single piece of spring wire to twisted Z-shape having a cross member and a pair of end members at each end of said cross-member, each end member forming approximately a right angle with the cross-member and with the other end member, each of said end members having a free end thereof hooked toward the other end member.

21. The gutter guard of claim 20 wherein said hooks are reversible and each have two similarly shaped halves each alternatively either attachable to the strip or engageable with the upper edge of the outer side of the gutter.

22. The gutter guard of claim 20 wherein the hooks have a sharp end engageable with the outside of the gutter.

* * * * *